United States Patent [19]

Dudman

[11] Patent Number: 4,760,889

[45] Date of Patent: Aug. 2, 1988

[54] HIGH BENDING STRENGTH RATIO DRILL STRING COMPONENTS

[76] Inventor: Roy L. Dudman, P.O. Box 1281, Luling, Tex. 78648

[21] Appl. No.: 909,164

[22] Filed: Sep. 19, 1986

[51] Int. Cl.[4] ..... E21B 17/00

[52] U.S. Cl. ..... 175/320; 166/242; 138/155; 138/177

[58] Field of Search ..... 175/320, 424; 285/333, 285/922; 138/155, 109, 177; 166/99, 242, 301

[56] References Cited

U.S. PATENT DOCUMENTS 2,539,057 1/1951 Brown ..... 285/333
2,676,820 4/1954 Boice ..... 138/177

OTHER PUBLICATIONS

Technical Drilling Tools, Inc. publication No. 3, "Drill Collars and Drilling String Accessories", May 1979.

*Primary Examiner*—Stephen J. Novosad
*Assistant Examiner*—Bruce M. Kisliuk
*Attorney, Agent, or Firm*—Vaden, Eickenroht, Thompson & Boulware

[57] ABSTRACT

A drill collar is disclosed having a fishing neck just behind the pin end, which has a reduced dimension compared with the box end. Hence, the tool is particularly well suited for being oriented with its pin end up in a drill string. The BSR is enhanced while the collar retains good "fishability", and "washoverability", characteristics.

15 Claims, 3 Drawing Sheets

HIGH BENDING STRENGTH RATIO DRILL STRING COMPONENTS

BACKGROUND OF THE INVENTION

1. Field of the Invention

This invention pertains to drill string components such as used in the oil, gas, water and mining industry, and especially to components thereof employing the use of a fishing neck at the pin end thereof to retain fishability, the employment thereof in a pin up direction also enhancing the bending strength ratio (BSR) of the drill string and dimensionally permitting the use of larger, stronger connections.

2. Description of the Prior Art

Many drill collar connection failures are a result of bending stresses rather than torsional stresses. The American Petroleum Institute defines BSR as follows:

$$BSR = \frac{\frac{D^4 - b^4}{D}}{\frac{R^4 - d^4}{R}},$$

wherein

BSR=Bending Strength Ratio,

D=Outside diameter of pin and box, d=Inside diameter of bore, b=Thread root diameter of box threads at the end of pin, and R=Thread root diameter of pin threads ¾ inch from shoulder of pin.

A connection that has a BSR of 2.50:1 is generally accepted as an average balanced connection. However, the acceptable range may vary from 3.20:1 to 1.90:1 depending on the drilling conditions. As the outside diameter of the box will wear more rapidly than the pin inside diameter, the resulting bending strength ratio will be reduced accordingly. This imbalance in wear rate is because the outside is exposed to erosion caused by drilling fluid laden with abrasive formation cuttings and by the rubbing on the side of the hole. The inside diameter of the pin increases very slowly, by comparison, due to the relatively clean drilling fluid being pumped through the bore. When the bending strength ratio falls below 2.00:1, connection troubles can begin. These troubles may consist of swollen boxes, split boxes, or fatigue cracks in the boxes at the last engaged thread.

It should be noted that the bending strength ratio does not depend on the outside diameter or the inside diameter of the body of the tool members, but only with respect to the respective dimensions at the box and pin, or the dimensions at the connection ends of the members.

Ordinarily drill strings are run into the hole with the pin ends of the members down and the box ends of the members up. When the string is stuck in the hole at a given location for one of many, many reasons, it is standard procedure to stop the drilling process and disconnect the string at the location above the first section of pipe that is stuck. Then, an overshot fishing tool is used to slide over the "fish" (i.e., the section left in the hole), to grapple engage the fish and then to pick it up. The grapple usually is either a spiral or basket grapple and operates much like a "chinese finger". The grapple has internal wickers and a tapered exterior that allow the fish to enter by expanding the grapple into a loosely matching helically tapered spiral section in the bowl of the fishing tool. When picking up the fish, the grapple is contracted by the tapers in the bowl, thus engaging the teeth more as the pull is increased. The overshot fishing tool can be released by jarring down to disengage the taper on the grapple from the taper in the bowl, then slowly rotating the overshot to the right while pulling up.

If the fishing tool cannot free the fish by pulling, then it is often necessary to "washover" the stuck section. "Washover" is the process that is begun by the running into the hole of several joints of flush joint casing with an inside diameter slightly larger than the fish and an outside diameter less than the diameter of the hole. Washover pipe is then run into the hole on the drill pipe and the fish is milled over, also cutting and washing the formation away from the fish in an attempt to free the fish so it can be retrieved with an overshot fishing tool, as described above.

As mentioned above, decreasing the outside diameter of the box decreases the BSR. In large hole situations, drill string components with larger pipe connecting end outside diameters, and, hence, attendant larger BSR's, can be employed with the above fishing problems being accepted. However, the closer tolerances involved with relatively small hole sizes make it necessary to run small drill string components with a low BSR. The prospects of ordinary wear or fishing manipulation reducing the BSR below acceptable limits creates problems in living with the abovedescribed marginal BSR numbers. For example, in a 6" I.D. range of hole sizes, the 4¾" O.D. size drill collars and corresponding drill string components with a 2¼" I.D. which are normally used, only have a bending strength ratio of 1.85:1 when new. This is a number that is already smaller than preferred practice dictates.

As shown below, the BSR increases as the pin inside diameter increases while the BSR decreases quite rapidly as the box outside diameter decreases.

| Connection | I.D. | 4¾" O.D. | 5" O.D. | 5¼" O.D. |
|---|---|---|---|---|
| N.C. 38/3½" | 2½" | 2.12:1 | 2.62:1 | 3.17:1 |
| I.F. | 2¼" | 1.85:1 | 2.38:1 | 2.84:1 |
| | 2" | 1.80:1 | 2.25:1 | 2.67:1 |
| | 1¾" | 1.70:1 | 2.15:1 | 2.62:1 |

Therefore, it is a feature of the present invention to provide an improved drill string tubular product structure having a higher BSR for small drill collars than conventional product structures, while permitting a fishing operation without critically lowering the BSR. Another feature of the invention permits the use of a larger, stronger connection with an acceptable BSR; for example, NC 40/4" F.H., 5¼" O.D.×2½" I.D., with a BSR of 2.30:1 and over 30% increase in torsional strength.

SUMMARY OF THE INVENTION

A structure in a drill string component is provided so as to maintain a high bending strength ratio in the drill string connections for situations when relatively small hole sizes made it necessary in the prior art to run small drill string components with a low BSR. A "drill collar" and a "drill pipe" are generic names for a length or joint of a tubular product intended for inclusion in a drill string of such products. There are many special drill collars and drill pipes, such as heavier than normal, or including special tool components (e.g., cutters).

Normal lengths of drill pipe as well as these special lengths are all referred to generically as drill collars and drill pipe. Sometimes, such lengths of pipe are also referred to as "rotary subs". The drill string component disclosed herein is designed to be included in the drill string with its pin end up. The body portion of the component joins the box portion at one end and the pin portion at the other. In the case of drill collars, the box portion has either the same outside diameter as the body portion or a larger outside diameter than the body portion. In the case of drill pipe, the box portion has a larger outside diameter than the body portion. The pin section has a larger diameter than the body portion but the pin section is smaller than the outside diameter of the box portion. The pin section includes a so-called "fishing neck" adjacent the pin, which has a uniform outside diameter which extends downwardly from the pin and which is smaller than the outside diameter of the box portion. The uniform diameter provides a surface with which the grapple of a fishing tool may engage as it is lowered over the pin.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope as the invention may admit to other equally effective embodiments.

In the Drawings

DESCRIPTION OF THE PREFERRED EMBODIMENT

Figure 1:
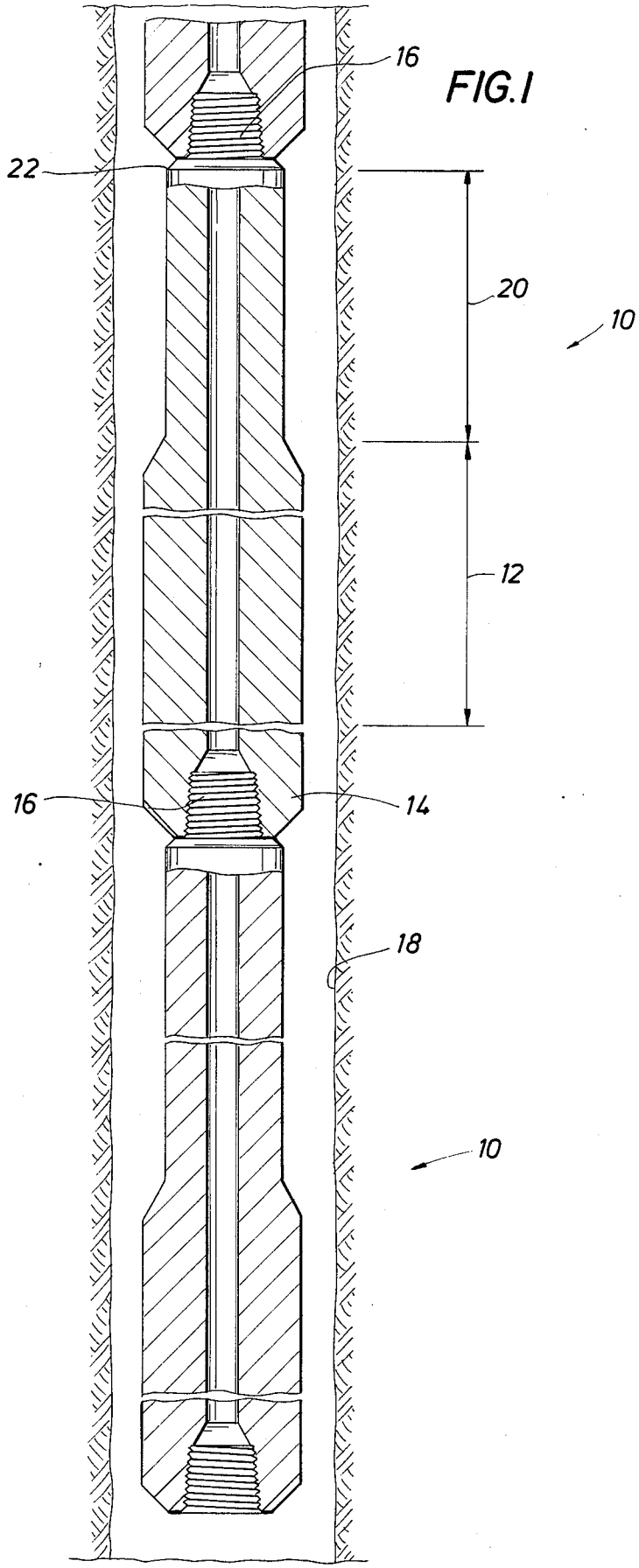
FIG. 1 is a longitudinal sectional view of a preferred embodiment of a pair of interconnected drill collars in accordance with the present invention.

Now referring to the drawings, and particularly FIG. 1, a portion of a drill string employing drill collars in accordance with the present invention is illustrated. Typically, a drill collar 10 comprises three portions or sections, namely, a body section 12, which runs the majority of the length of the overall drill collar, a box section 14 and a pin section having a pin end 16. The box section is the female part of the connection and the pin section is the male part of the connection. As can be readily seen from the drawing, the pin section is pointed up in hole 18.

Located below pin end 16 is a fishing neck 20. Below fishing neck 20 is body section 12. The shoulder of the pin at outside bevel diameter 22 has to be adequate to carry the torsional load applied to the connection. This shoulder width is initially machined at a bevel diameter of 4-37/64", 4-49/64", and 4-61/64", respectively, for corresponding with 4¾ O.D., 5" O.D., and 5¼" O.D. box dimensions. The pin strength does not change due to a change in its outside diameter as long as an adequate shoulder width is maintained.

Figure 1A:
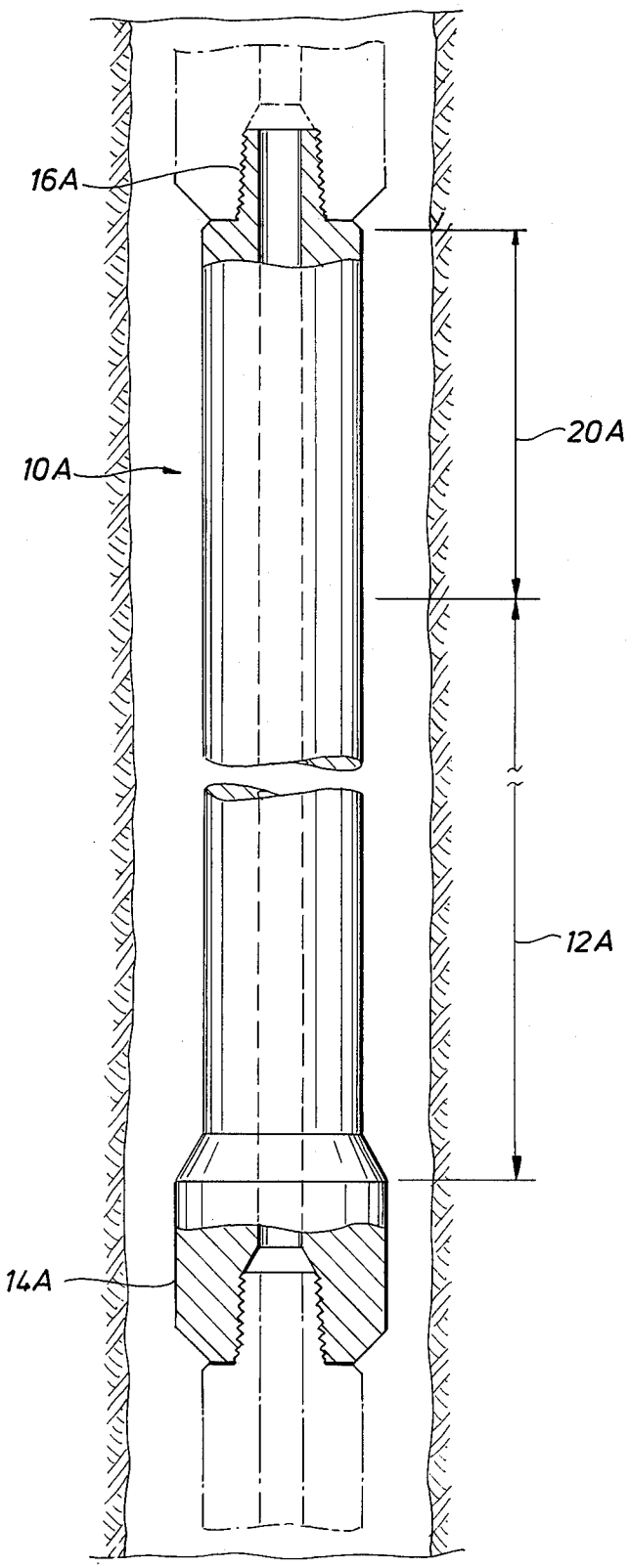
FIG. 1A is a longitudinal sectional view of an alternative embodiment of a drill collar in accordance with the present invention.

Dimensionally, the box and pin sections are both relatively short in length compared with the body section. The body section is usually on the order of 28 feet in length and the end sections are usually on the order of 18"–24" in length. The section of the drill collar shown in the drawing referred to as fishing neck 20 is normally a minimum of 18" in length. As shown in FIG. 1A, in an alternative embodiment of drill collar 10 shown in FIG. 1, the entire body section 12A may be of the same outside diameter of the fishing neck 20A.

The BSR applies to the rotary shouldered connection or the threads connecting the drill string components, with the outside diameter of the box primarily controlling the bending strength ratio. The outside diameter of the pin section and the outside diameter of the body can be reduced without reducing the bending strength ratio. Hence, the larger outside diameter of the box needs to be only a few inches in length, i.e., sufficient in length to strengthen the box threaded connection. A sufficient length to allow the box connection to be reworked several times is normally used.

Figure 1B:
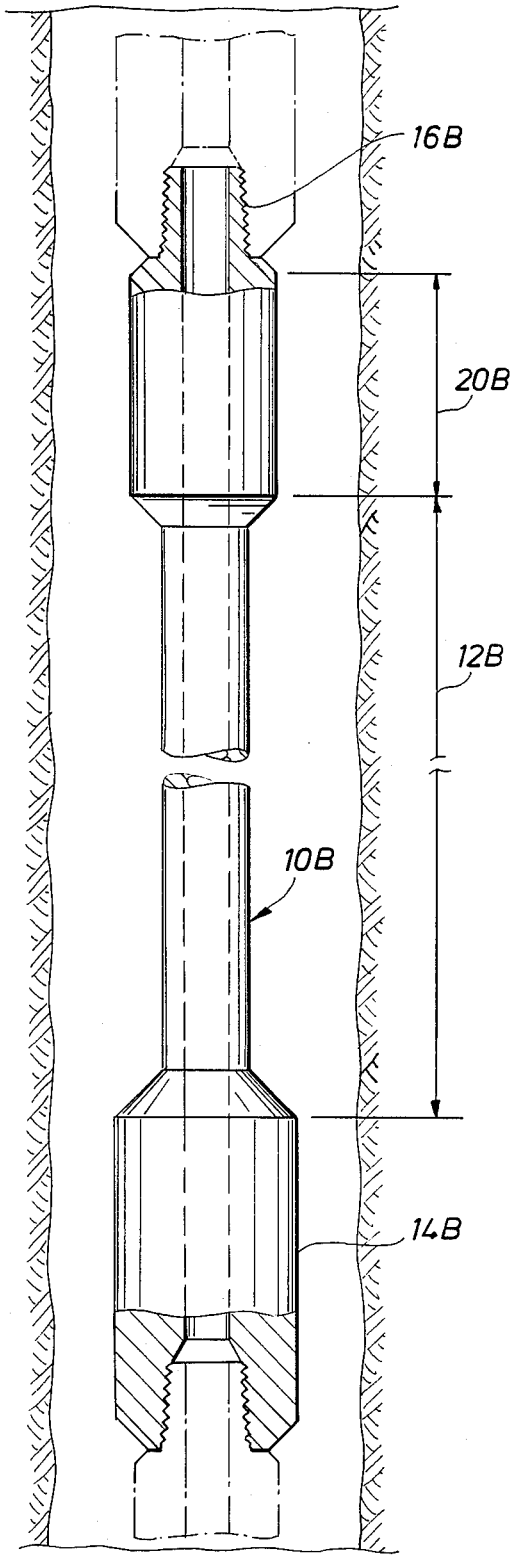
FIG. 1B is a longitudinal sectional view of a preferred embodiment of a drill pipe in accordance with the present invention.

When the body section diameter is the same as or less than the diameter of the pin section, as shown in the case of body section 12B of drill pipe 10B of FIG. 1B, the body section can be washed over without milling off any steel. Or, the structure of the body section described above and shown in the FIG. 1 can be left alone and at a larger dimension than if the box end were up, to provide weight and stiffness. The reduced fishing neck of the pin end section allows the fishing overshot to engage the fish, as discussed above.

When necessary to washover the full length of a section, if only the box end section has the larger diameter, it can be easily milled off with the mill shoe of the wash pipe. In summary, with only a fishing neck adjacent the pin end, the operator has a heavier, stiffer drill collar with a higher bending strength ratio, while maintaining "fishability". With the pin end and the body section reduced, as in drill collar 10A, the operator has gained, with respect to the pin down structure of the prior art, a higher BSR while maintaining "fishability" and "washoverability".

Figure 1C:
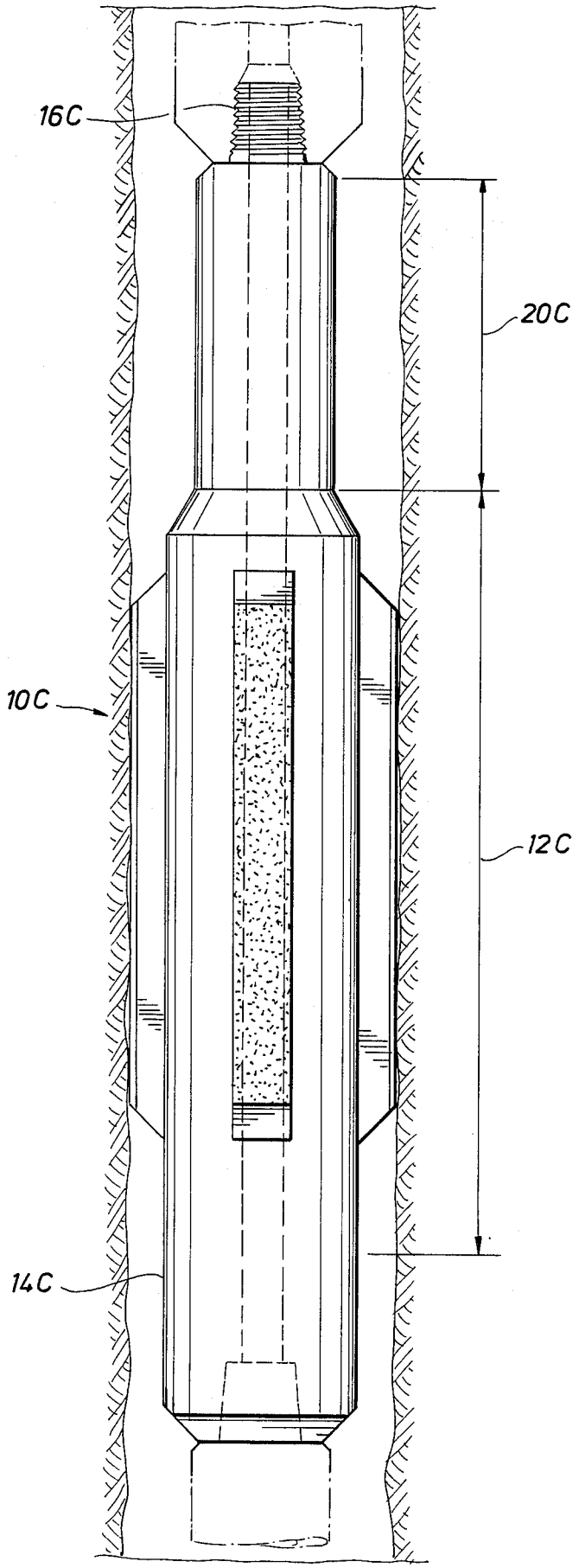
FIG. 1C is a longitudinal sectional view of a stabilizer in accordance with the present invention.

It has been mentioned that special tools included in a drill string often have special added features not included in an ordinary drill collar. Wear knots, reamer cutters, stabilizer blades, or elevator or slip recesses, can be included, for example. The body portion of a reamer or a stabilizer, such as that shown at 10C in FIG. 1C, would usually have an outside diameter larger than both the pin and box sections. With the pin up configuration described above, the tool would still have "fishability". The box section would have a larger outside diameter compared with a pin down tool of the same type included in the prior art and thus would provide a larger BSR. Any washover of such a tool would require milling over the body to remove the reamer cutters or the stabilizer blades and the short box section.

Although the above description has been with respect to a drawing showing a drill collar having a body section and a box section of the same outside diameter, it is understood that a box having an outside diameter of greater dimension than the body section would be equally satisfactory.

While a particular embodiment of the invention has been shown, it will be understood that the invention is not limited thereto. Many modifications may be made, which will become apparent to those skilled in the art.

What is claimed is:

1. A drill string component adapted to be threadedly connected as part of a rotary drill string which extends downwardly within a well bore to a drill bit at its lower end, comprising a tubular joint having a body portion which extends a major portion of the entire length of the component and which is of uniform outside diameter throughout substantially its entire length, a box portion including a box at the lower end of the body portion, and a pin portion at the upper end of the body portion including a pin and a fishing neck having a uniform outside diameter which extends downwardly from the pin and which is smaller than the outside diameter of the box portion, each of the box and pin having threads of the same size and type for connecting with similarly threaded drill string components.

2. A drill string component of the character defined in claim 1, wherein the component is a drill collar and the uniform outside diameter of the body portion thereof is smaller than that of the box portion.

3. A drill string component of the character defined in claim 1, wherein the component is a drill collar and the uniform outside diameter of the body portion thereof is at least as large as that of the box portion.

4. A drill string component of the character defined in claim 1, wherein the component is a drill pipe and the uniform outside diameter of the body portion thereof is smaller than that of the box portion or pin portion.

5. A drill string component of the character defined in claim 1, wherein the uniform outside diameter of the body portion is larger than that of the box portion.

6. A plurality of drill string components adapted to be connected as part of a rotary drill string which extends downwardly within a well bore to a drill bit at its lower end, comprising a first component including a tubular joint having a pin portion at its upper end and a box portion at its lower end, a second component including a tubular joint having a pin portion at its upper end adapted to be connected to the box portion of the first component and a box portion at its lower end adapted to be connected to the pin portion of a third component, the pin portion of each component including a pin and a fishing neck having a uniform outside diameter which extends downwardly from the pin, the outer diameter of the box portion of each component being larger than that of the fishing neck of the pin portion thereof, the outer diameter of the box portion of the first component being larger than that of the fishing neck of the second component, and one of the components having a body portion intermediate the fishing neck and box portion which extends a major portion of the entire length thereof.

7. A plurality of drill string components of the character defined in claim 6, wherein the one component is a drill collar and the body portion thereof has an outside diameter which is smaller than that of the box portion.

8. A plurality of drill string components of the character defined in claim 6, wherein the one component is a drill collar and the body portion thereof has an outside diameter which is at least as large as that of the box portion.

9. A plurality of drill string components of the character defined in claim 6, wherein the one component is a drill pipe and the body portion thereof has an outside diameter which is smaller than that of the box portion or pin portion.

10. A plurality of drill string components of the character defined in claim 6, wherein the body portion has an outside diameter which of the one component is larger than that of the box portion.

11. A plurality of drill string components adapted to be connected as part of a rotary drill string which extends downwardly within a well bore to a drill bit at the lower end, comprising a first component including a tubular joint having a pin portion at its upper end and a box portion at its lower end, a second component including a tubular joint having a pin portion at its upper end adapted to be connected to the box portion of the first component and a box portion at its lower end adapted to be connected to the pin portion of a third component, the pin portion of the second component including a pin and a fishing neck having a uniform outside diameter which extends downwardly from the pin, the outer diameter of the box portion of the first component being larger than that of the fishing neck of the second component, and one of the components having a body portion intermediate the fishing neck and box portion which extends a major portion of the entire length of the one component.

12. A plurality of drill string components of the character defined in claim 11, wherein the one component is a drill collar and the body portion thereof has an outside diamter which is smaller than that of the box portion.

13. A plurality of drill string components of the character defined in claim 11, wherein the one component is a drill collar and the body portion thereof has an outside diameter which is at least as large as that of the box portion.

14. A plurality of drill string components of the character defined in claim 11, wherein the one component is a drill pipe and the body portion thereof has an outside diamter which is smaller than that of the box portion or pin portion.

15. A plurality of drill string components of the character defined in claim 11, wherein the body portion of the one component has an outside diamter which is larger than that of the box portion.

* * * * *